US011098487B1

(12) United States Patent
Rufenacht

(10) Patent No.: US 11,098,487 B1
(45) Date of Patent: Aug. 24, 2021

(54) SELF-CONCEALING REBAR CHAIR

(71) Applicant: Molin Concrete Products Company, Lino Lakes, MN (US)

(72) Inventor: Michael John Rufenacht, Lake Elmo, MN (US)

(73) Assignee: Molin Concrete Products Company, Lino Lakes, MN (US)

( * ) Notice: Subject to any disclaimer, the term of this patent is extended or adjusted under 35 U.S.C. 154(b) by 0 days.

(21) Appl. No.: 17/093,930

(22) Filed: Nov. 10, 2020

(51) Int. Cl.
*E04C 5/16* (2006.01)

(52) U.S. Cl.
CPC ..... *E04C 5/168* (2013.01)

(58) Field of Classification Search
CPC ... E04C 5/168; E04C 5/16; E04C 5/18; E04C 5/20
See application file for complete search history.

(56) References Cited

U.S. PATENT DOCUMENTS

| | | | | | |
|---|---|---|---|---|---|
| 1,014,630 | A * | 1/1912 | Morrill | E04G 11/28 | 249/20 |
| 1,352,642 | A * | 9/1920 | White | E04C 5/20 | 52/687 |
| 2,412,307 | A * | 12/1946 | Tatsch | E04C 5/18 | 52/99 |
| 4,498,270 | A | 2/1985 | Ilukowicz | | |
| 4,682,461 | A | 7/1987 | Sizemore | | |
| 4,741,143 | A * | 5/1988 | Foster, Jr. | E04C 5/201 | 405/239 |
| 7,237,367 | B1 | 7/2007 | Sorkin | | |
| 7,845,136 | B1 | 12/2010 | Sorkin | | |
| 9,297,163 | B2 | 3/2016 | Golledge et al. | | |
| 2020/0224418 | A1* | 7/2020 | Toyoda | E04C 5/167 | |

FOREIGN PATENT DOCUMENTS

| | | | | |
|---|---|---|---|---|
| FR | 2303133 | A1 * | 10/1976 | E04C 5/20 |
| WO | 96/21782 | A1 | 7/1996 | |
| WO | 98/59129 | A1 | 12/1998 | |
| WO | 2006/015432 | A1 | 2/2006 | |

* cited by examiner

*Primary Examiner* — Adriana Figueroa
(74) *Attorney, Agent, or Firm* — Sherrill Law Offices, PLLC

(57) ABSTRACT

A rebar chair with a gravel particle affixed to each distal tip of the chair for providing a concealing offset between each distal tip and a support surface.

18 Claims, 6 Drawing Sheets

SELF-CONCEALING REBAR CHAIR

BACKGROUND

Rebar is a steel bar or mesh of steel wires used as a tension device to reinforce concrete structures by significantly increasing the tensile strength of the concrete structure.

Rebar is typically elevated upon rebar supports or chairs prior to a pour in order to embed the rebar deep within the concrete structure. This results in a spaced array of chair tips exposed through the lower surface of the reinforced concrete structure. While of little concern when the lower surface remains hidden from view and shielded from environmental elements underneath the concrete structure (e.g., floors, driveways and roadways), it is of significant concern when the concrete structure is intended to be deployed with the lower surface visually displayed and exposed to the environmental elements (e.g., precast concrete wall panel).

Accordingly, a substantial need exists for an implement, apparatus, system or method capable of supporting rebar in an elevated position prior to a pour but does not visually blemish the lower surface of the reinforced concrete structure with an array of exposed rebar chair distal tips.

SUMMARY OF THE INVENTION

A first aspect of the invention is a rebar chair for use in supporting rebar in an elevated position. The rebar chair comprises a scaffold with a proximal end configured and arranged to support rebar a distance above a support surface, and a distal end having one or more distal tips configured and arranged to rest upon the support surface. The invention is characterized by a gravel particle affixed to each distal tip of the rebar chair for providing an offset between each distal tip and the support surface.

A second aspect of the invention is a method of forming a rebar assembly using rebar chairs in accordance with the first aspect of the invention. The method includes securing the proximal end of a plurality of the rebar chairs to a length of rebar with the rebar chairs extending in the same radial direction from the length of rebar.

A third aspect of the invention is a method of forming a rebar assembly array using rebar chairs in accordance with the first aspect of the invention. A first embodiment of the third aspect of the invention includes securing the proximal end of a plurality of rebar chairs to a plurality of lengths of rebar to form a longitudinal and lateral extending planar array of rebar with the rebar chairs extending in the same transverse direction from the rebar array.

A second embodiment of the third aspect of the invention includes (i) laying out a plurality of individual lengths of rebar in a longitudinal and lateral extending planar array, and (ii) securing the proximal end of a plurality of spaced rebar chairs to the lengths of rebar with the rebar chairs extending in the same transverse direction from the array.

A fourth aspect of the invention is a method of making a rebar reinforced precast concrete panel with concealed rebar chairs in a mold having a floor surface bounded by sidewalls. A first embodiment of the fourth aspect of the invention comprises (i) securing the proximal end of a plurality of rebar chairs in accordance with the first aspect of the invention to each of a plurality of lengths of rebar with the rebar chairs extending in the same radial direction from each length of rebar, (ii) placing the plurality of rebar assemblies into the mold with the aggregate particles in contact with the floor of the mold to form an elevated pattern of rebar within the mold, (iii) casting concrete into the mold so as to submerge the elevated pattern of rebar, (iv) allowing the cast concrete to cure, and (v) removing the rebar reinforced cured concrete panel from the mold.

A second embodiment of the fourth aspect of the invention comprises (i) securing the proximal end of a plurality of rebar chairs in accordance with the first aspect of the invention to the rebar to form a longitudinal and lateral extending planar array of rebar with the rebar chairs extending in the same transverse direction from the array of rebar to form a rebar assembly array, (ii) placing the rebar assembly array into the mold with the aggregate particles in contact with the floor of the mold to form an elevated pattern of rebar within the mold, (iii) casting concrete into the mold so as to submerge the elevated pattern of rebar, (iv) allowing the cast concrete to cure, and (v) removing the rebar reinforced cured concrete panel from the mold.

A third embodiment of the fourth aspect of the invention comprises (i) securing the proximal end of a plurality of rebar chairs in accordance with the first aspect of the invention to each of a plurality of lengths of rebar with the rebar chairs extending in the same radial direction from each length of rebar, (ii) placing the plurality of rebar assemblies into the mold with the aggregate particles in contact with the floor of the mold to form an elevated pattern of rebar within the mold, (iii) casting concrete into the mold so as to submerge the elevated pattern of rebar, (iv) allowing the cast concrete to cure, and (v) removing the rebar reinforced cured concrete panel from the mold.

A fifth aspect of the invention is a rebar reinforced precast concrete panel. The panel has a plurality of rebar chair scaffolds concealingly embedded therein by an aggregate particle affixed to a distal end of the scaffold prior to casting of the concrete panel whereby the distal end of the scaffold is recessed from an exterior surface of the concrete panel.

DETAILED DESCRIPTION OF A PREFERRED EMBODIMENT

Nomenclature Table

| REF. NO. | DESCRIPTION |
|---|---|
| 100 | Rebar Chair |
| 120 | Scaffold |
| 121 | Proximal End of Scaffold |
| 122 | Distal End of Scaffold |
| $122_{Tip}$ | Distal Tip |

-continued

| REF. NO. | DESCRIPTION |
|---|---|
| 140 | Gravel Particle |
| 141 | Flat Face of Gravel Particle |
| 160 | Adhesive |
| 180 | Bezel |
| 200 | Length of Rebar |
| 220 | Rebar Assembly |
| 240 | Rebar Assembly Array |
| x | Longitudinal Axis |
| y | Lateral Direction |
| z | Transverse Direction |
| C | Concrete |
| M | Mold |
| F | Floor or Support Surface of Mold |
| S | Sidewalls of Mold |

DETAILED DESCRIPTION OF THE INVENTION INCLUDING A PREFERRED EMBODIMENT

Construction

Rebar Chairs

Concrete structures, including precast concrete wall panels, are often reinforced with rebar 200 to improve tensile strength. Rebar 200 is supported in a transverse direction z above a floor surface F prior to casting by rebar chairs 100. When the concrete structure is a precast concrete wall panel the rebar 200 is typically supported a distance of about 2 to 10 cm above the floor F. A length of rebar 200 supported upon a plurality of rebar chairs 100 extending in the same axial direction from the length of rebar 200 constitutes a rebar assembly 220. An overlapping pattern of several longitudinally x extending rebar assemblies and several laterally y extending rebar assemblies constitutes a rebar assembly array 240.

Figure 1:
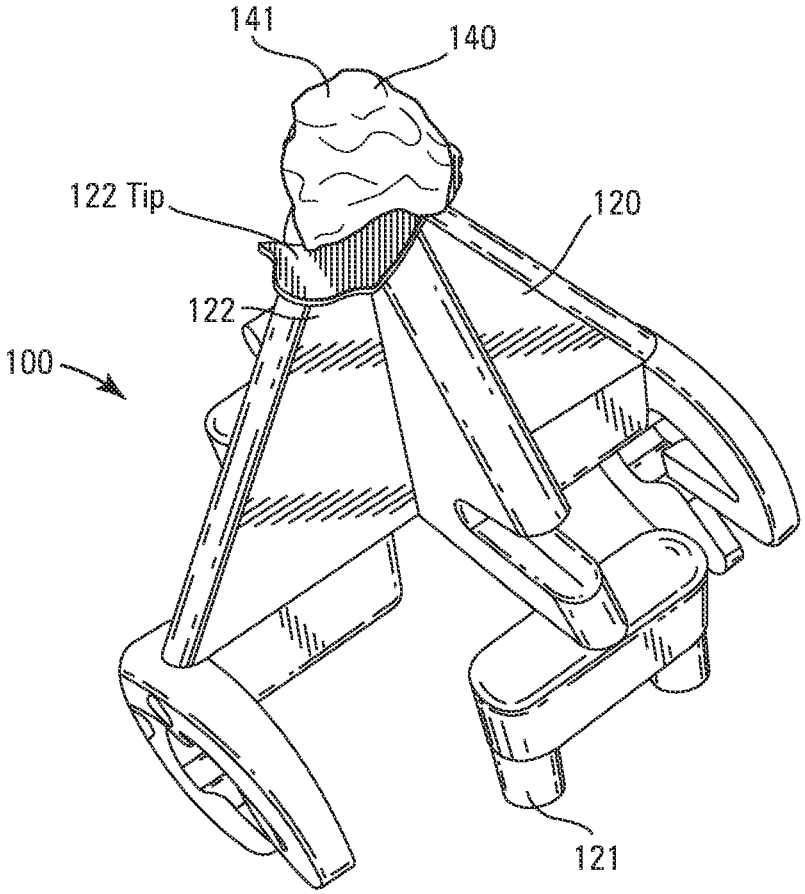
FIG. 1 is a perspective view of one embodiment of the invention.

Referring to FIG. 1, rebar chairs 100 are formed of a scaffold 120 with a proximal end 121 configured to capture and support a length of rebar 200 and a distal end 122 with a distal tip $\mathbf{122}_{Tip}$ configured to contact and rest upon the floor F. The scaffold 120 can be metal or plastic, and can have a single or multiple distal tips $\mathbf{122}_{Tip}$.

Referring to FIGS. 1, 2A, 2B and 5, a gravel particle 140 is attached to the distal tip $\mathbf{122}_{Tip}$ of the rebar chair scaffold 120. The attached gravel particle 140 is effective for recessing the entire rebar chair 100 into the concrete structure, thereby fully concealing the rebar chair 100 within the structure. Concrete is comprised of three basic components: water, aggregate (rock, sand, or gravel) and cement, most typically Portland cement. The gravel particle 140 attached to the distal tip $\mathbf{122}_{Tip}$ of the rebar chair scaffold 120 will itself be exposed through the lower surface of the reinforced concrete structure, but because gravel is one of the basic components of concrete the gravel particle 140 visually blends into the surface of the concrete structure and effectively disappears.

The gravel particles 140 may be natural or synthetic stones. Each gravel particle 140 is preferably between about 0.1 to 3 $cm^3$. Gravel particles 140 of less than about 0.1 $cm^3$ are difficult to attach to the scaffold 120 and provide an insufficient offset from the surface of the concrete structure, while gravel particles 140 of greater than about 3 $cm^3$ are themselves rather noticeable on the surface of the concrete structure, particularly when they appear as a uniform pattern on the surface.

The leading exposed face 141 of the gravel particle 140 is preferably relatively flat to facilitate supportive contact with the floor F.

Figure 2A:
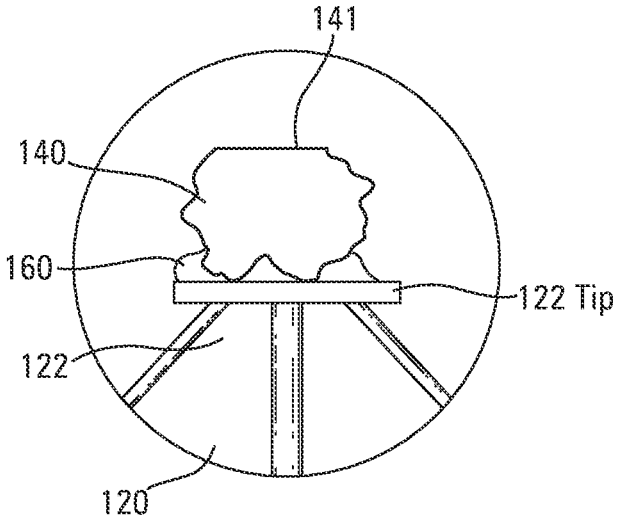
FIG. 2A is an enlarged side view of the distal end of the invention depicted in FIG. 1.
Figure 2B:
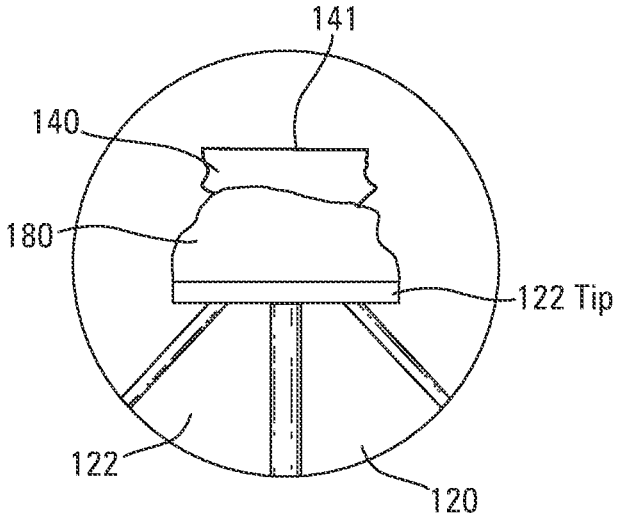
FIG. 2B is an enlarged side view of the distal end of the invention depicted in FIG. 1 employing an alternative mechanical affixation of the gravel particle to the scaffold.

The gravel particle 140 can be secured to the distal tip $\mathbf{122}_{Tip}$ of the rebar chair scaffold 120 by any suitable means including specifically but not exclusively industrial adhesive 160 (FIG. 2A) and/or a bezel 180 (FIG. 2B).

Rebar Reinforced Precast Concrete Panel

Figure 5:
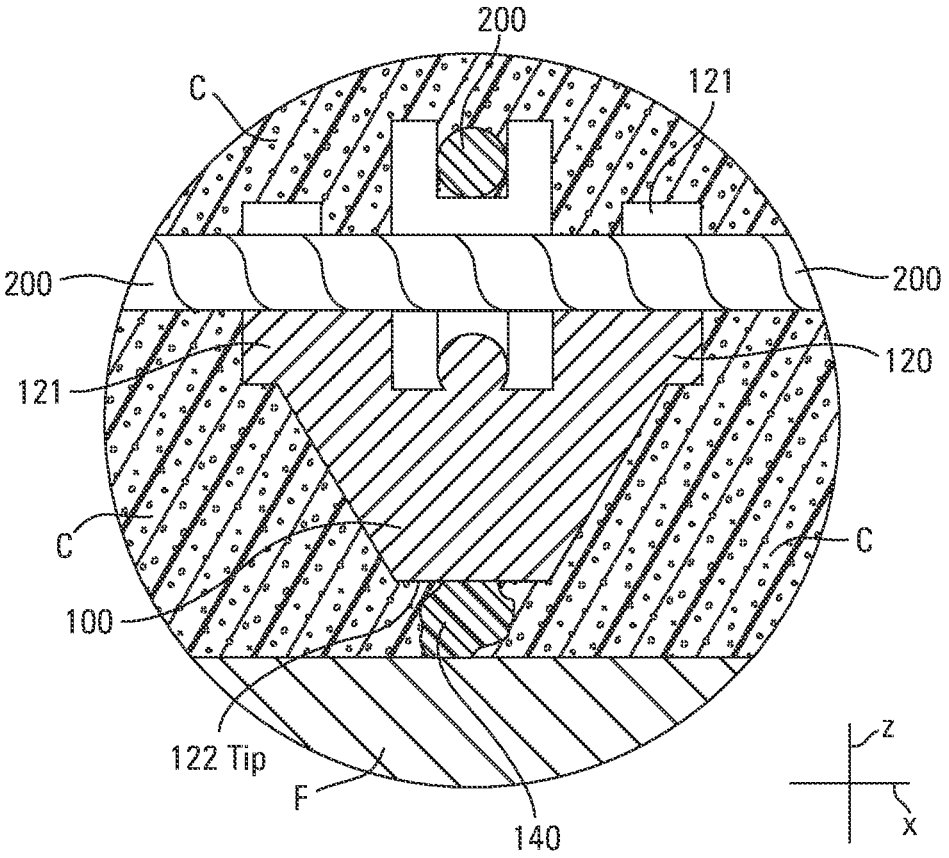
FIG. 5 is a cross-sectional side view of a portion of a rebar reinforced precast concrete panel depicting a rebar chair depicted in FIG. 1 embedded and concealed within the panel.

Referring to FIG. 5, an aesthetically appealing rebar reinforced precast concrete panel having no surface blemishes cause by exposed rebar chair distal tips $\mathbf{122}_{Tip}$ is achieved when a gravel particle 140 is secured to the distal tip $\mathbf{122}_{Tip}$ of each rebar chair 100 embedded into the panel. The rebar reinforced precast concrete panel includes rebar 200 and rebar chairs 100 both fully embedded within concrete. The gravel particle 140 attached to the distal tip $\mathbf{122}_{Tip}$ of each rebar chair 100 is exposed through the lower surface of the panel, but because gravel is one of the basic components of concrete the gravel particles 140 visually blend into the surface of the concrete structure and effectively disappear.

Method of Forming a Rebar Assembly and a Rebar Assembly Array

Figure 3:
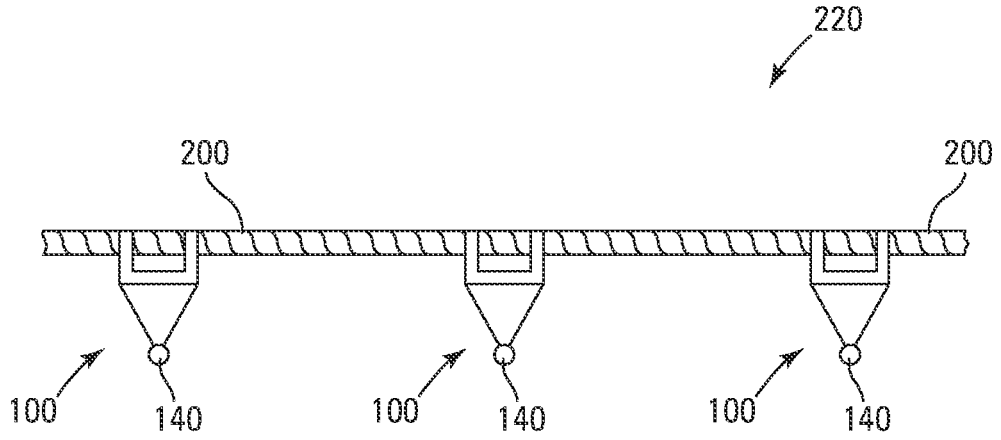
FIG. 3 is a schematic side view of one embodiment of a rebar assembly in accordance with the invention.

Referring to FIG. 3, a rebar assembly 220 can be formed by securing the proximal end 121 of a plurality of the rebar chairs 100 described herein to a length of rebar 200 with the rebar chairs 100 extending in the same radial direction from the length of rebar 200 whereby the gravel particles 140 attached to the rebar chairs 100 are linearly aligned.

Figure 4:
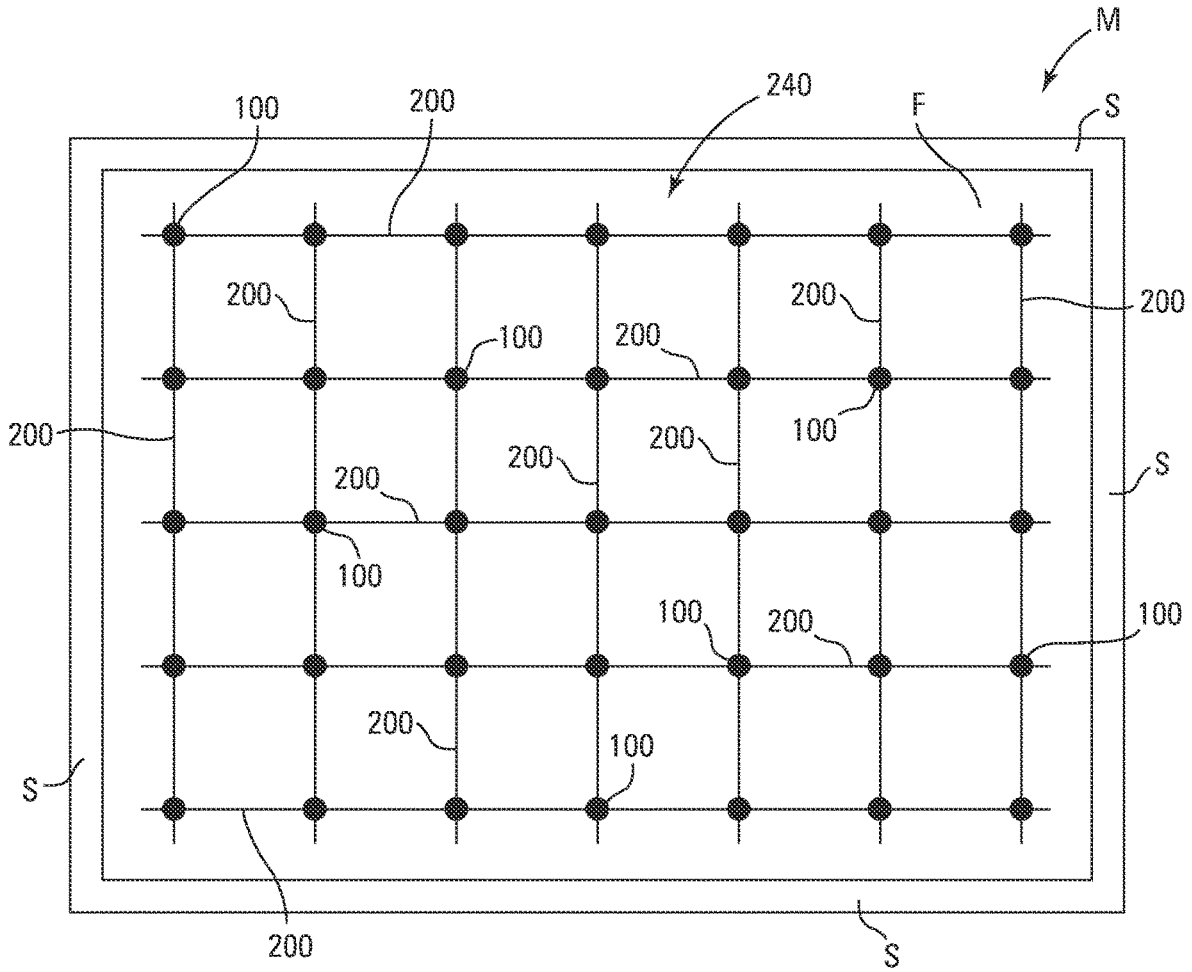
FIG. 4 is a schematic top view of one embodiment of a rebar assembly array in accordance with the invention placed within a mold.
Figure 4:
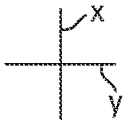

Referring to FIG. 4, a rebar assembly array 240 can be formed by securing the proximal end 121 of a plurality of rebar chairs 100 to a plurality of lengths of rebar 200 to form a longitudinal x and lateral y extending planar array of rebar 200 with the rebar chairs 100 extending in the same transverse z direction from the rebar array 240 whereby the gravel particles 140 attached to the rebar chairs 100 define a longitudinally and laterally extending flat plane. The rebar assembly array 240 can be formed by first laying out the lengths of rebar 200 in the appropriate pattern and then securing rebar chairs 100 to the lengths of rebar 200, or alternatively securing some or all of the rebar chairs 100 to the lengths of rebar 200 to form a plurality of rebar assemblies 220 first, and then laying out the rebar assemblies 220 in the appropriate pattern.

Referring to FIG. 5, a rebar reinforced precast concrete panel with fully concealed rebar chairs can be formed by (i) placing either a plurality of separate and independent rebar assemblies 220 or a rebar assembly array 240, each as described above, into a mold M bounded by sidewalls S, with the aggregate particles 140 on each rebar chair 100 in contact with the floor F of the mold M whereby the rebar 200 is elevated within the mold M, (iii) casting concrete into the mold M so as to submerge the elevated rebar 200, (iv) allowing the cast concrete to cure, and (v) removing the rebar reinforced cured concrete panel from the mold M.

I claim:

1. A rebar chair for use in supporting rebar in an elevated position, comprising a scaffold having a proximal end configured and arranged to support the rebar a distance above a support surface and a distal end having one or more distal tips configured and arranged to rest upon the support surface, characterized in that a gravel particle is affixed to each distal tip operable for directly contacting the support surface and thereby providing an offset between each distal tip and the support surface.

2. The rebar chair of claim 1 wherein the scaffold is metal.

3. The rebar chair of claim 1 wherein the scaffold is plastic.

4. The rebar chair of claim 1 wherein the one or more distal tips is a single distal tip.

5. The rebar chair of claim 1 wherein the one or more distal tips is a plurality of distal tips.

6. The rebar chair of claim 1 wherein the rebar chair is operable for supporting the rebar a distance between 2 and 10 cm above the support surface.

7. The rebar chair of claim 1 wherein each gravel particle is between about 0.1 $cm^3$ to 3 $cm^3$.

8. The rebar chair of claim 7 each gravel particles is a natural gravel stone.

9. The rebar chair of claim 8 wherein each gravel particle has at least one flat face.

10. The rebar chair of claim 1 wherein each gravel particle is adhesively affixed to the scaffold.

11. The rebar chair of claim 1 wherein each gravel particle is mechanically affixed to the scaffold.

12. A method of forming a rebar assembly using rebar chairs in accordance with claim 1, comprising the step of securing the proximal end of a plurality of the rebar chairs to a length of rebar with the rebar chairs extending in the same radial direction from the length of rebar.

13. A method of forming a rebar assembly array using rebar chairs in accordance with claim 1, comprising the step of securing the proximal end of a plurality of the rebar chairs to a plurality of lengths of rebar to form a longitudinal and lateral extending planar array of rebar with the rebar chairs extending in the same transverse direction from the array of rebar.

14. A method of forming a rebar assembly array using rebar chairs in accordance with claim 1, comprising the steps of:

(a) laying out a plurality of individual lengths of rebar in a longitudinal and lateral extending planar array, (b) securing the proximal end of a plurality of the rebar chairs in a spaced relationship to one another to the lengths of rebar with the rebar chairs extending in the same transverse direction from the array.

15. A method of making a rebar reinforced precast concrete panel with concealed rebar chairs in a mold having a floor surface bounded by sidewalls, comprising (a) securing the proximal end of a plurality of rebar chairs in accordance with claim 1 to each of a plurality of lengths of rebar with the rebar chairs extending in the same radial direction from each length of rebar to form a plurality of rebar assemblies, (b) placing the plurality of rebar assemblies into the mold with the gravel particles in contact with the floor of the mold to form an elevated pattern of rebar within the mold, (c) casting concrete into the mold so as to submerge the elevated pattern of rebar, (d) allowing the cast concrete to cure, and (e) removing the rebar reinforced cured concrete panel from the mold.

16. A method of making a rebar reinforced precast concrete panel with concealed rebar chairs in a mold having a floor surface bounded by sidewalls, comprising (a) securing the proximal end of a plurality of rebar chairs in accordance with claim 1 to a plurality of rebar to form a longitudinal and lateral extending planar array of rebar with the rebar chairs extending in the same transverse direction from the array of rebar to form a rebar assembly array, (b) placing the rebar assembly array into the mold with the gravel particles in contact with the floor of the mold to form an elevated pattern of rebar within the mold, (c) casting concrete into the mold so as to submerge the elevated pattern of rebar, (d) allowing the cast concrete to cure, and (e) removing the rebar reinforced cured concrete panel from the mold.

17. A method of making a rebar reinforced precast concrete panel with concealed rebar chairs in a mold having a floor surface bounded by sidewalls, comprising (a) laying out a plurality of rebar in a longitudinal and lateral extending planar array, (b) securing the proximal end of a plurality of spaced rebar chairs in accordance with claim 1 to the rebars with the rebar chairs extending in the same transverse direction from the array of rebars to form a rebar assembly array, (c) placing the rebar assembly array into the mold with the gravel particles in contact with the floor of the mold to form an elevated pattern of rebar within the mold, (d) casting concrete into the mold so as to submerge the elevated pattern of rebar, (e) allowing the cast concrete to cure, and (f) removing the rebar reinforced cured concrete panel from the mold.

18. A rebar reinforced precast concrete panel with a plurality of rebar chairs according to claim 1 wherein the scaffolds of each rebar chair is concealingly embedded within the concrete panel by the gravel particle affixed to the distal end of the scaffold operable for inwardly recessing the distal end of the scaffold from an exterior surface of the concrete panel.

* * * * *